US006446796B1

(12) United States Patent
Schmidt

(10) Patent No.: US 6,446,796 B1
(45) Date of Patent: Sep. 10, 2002

(54) BAG IN-PACK ENCLOSURE

(75) Inventor: Paul R. Schmidt, Neenah, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 09/621,806

(22) Filed: Jul. 21, 2000

(51) Int. Cl.[7] ..... B65D 69/00; B65D 30/00

(52) U.S. Cl. ..... 206/232; 383/122; 383/127; 206/831

(58) Field of Search ..... 383/38, 39, 40, 383/106, 120, 121, 127, 104, 122; 229/70; 206/232, 831; 53/474

(56) References Cited

U.S. PATENT DOCUMENTS

| | | | | | |
|---|---|---|---|---|---|
| 3,348,759 | A | * | 10/1967 | Johnson | 383/40 |
| 3,439,868 | A | * | 4/1969 | Kuhnle | 38/40 |
| 3,762,628 | A | | 10/1973 | Sargent | |
| 3,804,323 | A | * | 4/1974 | Bemel | 383/40 |
| 3,998,135 | A | | 12/1976 | Sargent | |
| 4,182,222 | A | | 1/1980 | Stahl | |
| 4,268,344 | A | | 5/1981 | Jones | |
| 4,345,393 | A | * | 8/1982 | Price et al. | 40/312 |
| 4,993,845 | A | * | 2/1991 | Faltynek | 383/40 |
| 5,009,518 | A | * | 4/1991 | Faltynek | 383/106 |
| 5,035,515 | A | * | 7/1991 | Crossman et al. | 383/38 |
| 5,127,743 | A | * | 7/1992 | Miller et al. | 383/109 |
| 5,290,391 | A | | 3/1994 | Czech et al. | |
| 5,363,966 | A | | 11/1994 | Czech et al. | |
| 5,762,260 | A | * | 6/1998 | Goglio | 229/199 |
| 6,068,181 | A | * | 5/2000 | Cai | 229/116.1 |
| 6,251,450 | B1 | * | 6/2001 | Giacoman | 426/106 |

* cited by examiner

*Primary Examiner*—Mickey Yu
*Assistant Examiner*—Jila M. Mohandesi
(74) *Attorney, Agent, or Firm*—Pauley Petersen Kinne & Erickson

(57) ABSTRACT

A bag in-pack enclosure wherein the enclosure is removably secured to an inner surface of a gusseted end of the bag adjacent an opening of the bag. The enclosure can be a pamphlet or a coupon, and can be a single sheet of material or a multi-folded piece of material. The bag is suitable for packaging disposable absorbent articles.

23 Claims, 4 Drawing Sheets

BAG IN-PACK ENCLOSURE

FIELD OF THE INVENTION

This invention is directed to a gusseted bag that displays an enclosure, such as a leaflet or coupon, located inside the bag.

BACKGROUND OF THE INVENTION

In addition to their primary function of packaging separate items together in one place, bags also provide multiple surfaces on which advertisements and other promotional information can be displayed. Quite often, bags containing products for sale also include an enclosure, such as a pamphlet or a coupon, along with the packaged products.

Some bags include coupons that are printed on the surface of the bag, which must be cut out of the bag in order for a consumer to be able to use the coupon. This type of coupon/bag combination poses a problem when the consumer desires to use the coupon before the bag is empty. If the consumer cuts the coupon out of the bag while the bag is at least partially full, the contents are prone to fall out of the bag.

Some bags include an enclosure inside the bag not secured to any part of the bag. These enclosures tend to sink to the bottom of the bag, in which case, consumers often don't realize that the enclosures are in the bag in the first place. Furthermore, these enclosures are often difficult to reach without removing all of the contents from the bag.

Some bags include a coupon inside the bag attached to the inside of the bag with a pressure sensitive label. These coupons are located along flat surfaces of the bag, often obstructed from view by printed matter on the outside of the bag. Since these coupons are not always easy to see, they can easily be overlooked by consumers.

Some bags include a "pocket" to hold an enclosure. The pockets typically hold the enclosure within an easily accessible region of the bag so that a consumer can easily retrieve the enclosure upon initially opening the bag. Furthermore, these pockets typically hold the enclosure clearly in view of the consumer so that they are not overlooked. However, these pockets add an additional layer inside the bag, making the bag somewhat bulky. Also, the bags require extra material and manufacturing costs.

There is a need or desire for a bag that clearly displays an enclosure within the bag, such as a leaflet or coupon, with minimal additional material and manufacturing costs.

There is also a need or desire for a method of making a bag that clearly displays an enclosure within the bag, requiring minimal additional material and manufacturing costs.

SUMMARY OF THE INVENTION

The present invention is directed to a bag that contains and clearly displays an enclosure, such as a leaflet or coupon. The enclosure is secured to one end of the bag and/or near an opening of the bag, so that the enclosure is immediately visible and available to the consumer upon opening the bag. Furthermore, when the bag is empty, particularly prior to being filled, the enclosure naturally lies flat within the bag, permitting manageable stacking and storage of bags on wickets, or the processing of online formed bags. In one embodiment of the invention, one end of the bag is gusseted and the enclosure is secured to the gusseted end of the bag, such that when the bag is opened to be filled, the gusseted end unfolds and consequently realigns the enclosure to a position perpendicular to its position when the bag is flat.

Inserting and securing the enclosure to the bag adds minimal cost and labor expenses to the bag manufacturing process. For example, a small amount of adhesive can be applied to either the enclosure or to the gusset of the bag, and the enclosure can then be adhered inside the bag.

The bag can be made of paper, or a polymer or polymers, or any other suitable bag material. The bag is the type of bag typically used for packaging personal care products. The enclosure is a single or multi-folded leaflet or coupon or the like.

With the foregoing in mind, it is a feature and advantage of the invention to provide a bag that clearly displays an enclosure within the bag, such as a leaflet or coupon, with minimal material and manufacturing costs added to the costs of making the bag alone.

It is another feature and advantage of the invention to provide a method of making a bag that clearly displays an enclosure within the bag, requiring minimal additional material and manufacturing costs.

DEFINITIONS

Figure 1:
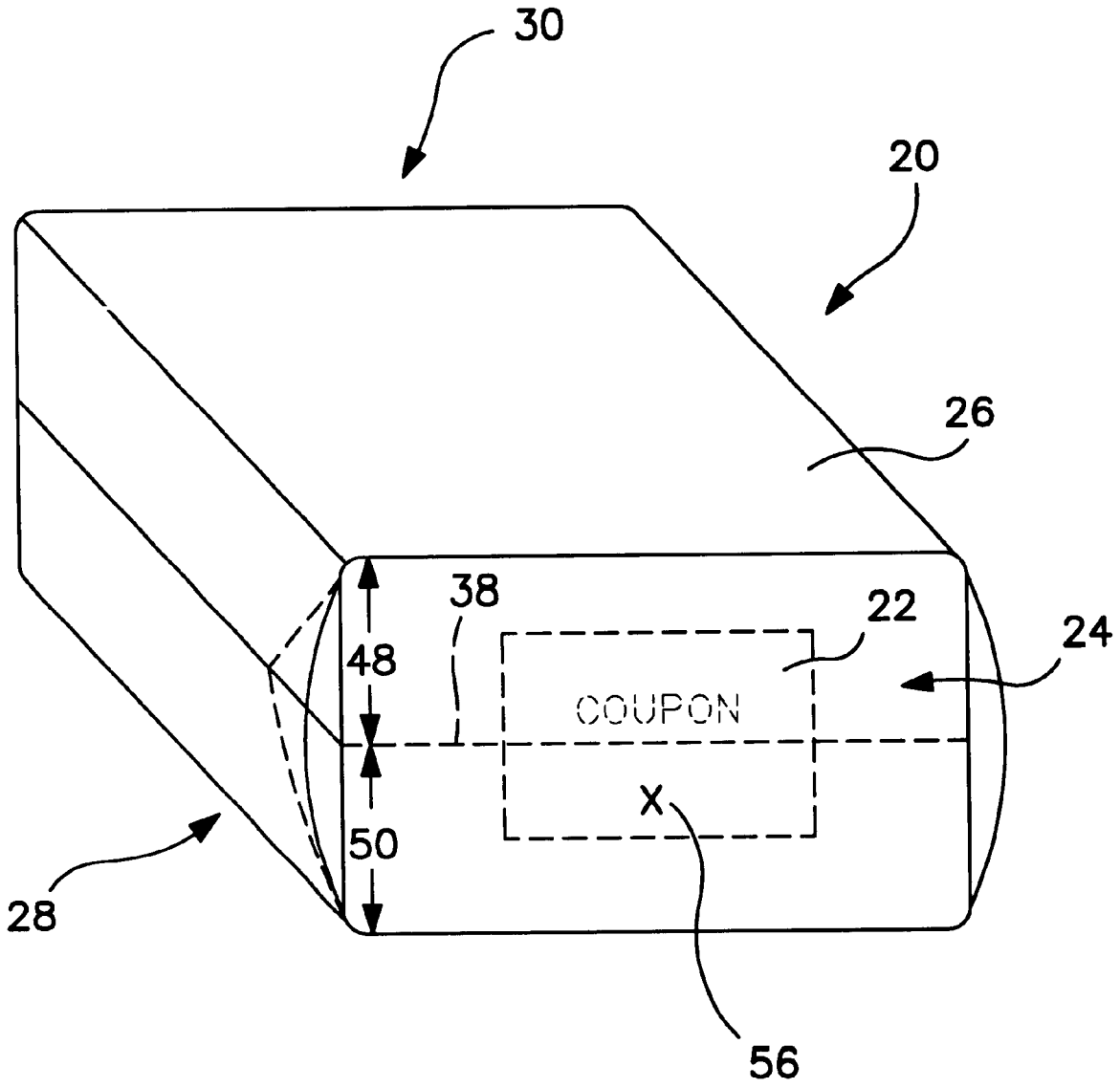
FIG. 1 is a perspective view of a bag in-pack enclosure wherein the bag is filled with contents.

Within the context of this specification, each term or phrase below will include the following meaning or meanings.

"Bonded" refers to the joining, adhering, connecting, attaching, or the like, of two elements. Two elements will be considered to be bonded together when they are bonded directly to one another or indirectly to one another, such as when each is directly bonded to intermediate elements.

"Film" refers to a thermoplastic film made using a film extrusion and/or foaming process, such as a cast film or blown film extrusion process. The term includes apertured films, slit films, and other porous films which constitute liquid transfer films, as well as films which do not transfer liquid.

"Gusset," "gusseting" refer to the tucking and sealing of bag material on an end or side of the bag in a manner that results in the formation of rectangular corners and edges on the end of the bag when the bag is erected from a flat position.

"Gusseted end" refers to a side of a three-dimensional shape formed from two layers with two gussets, or triangular seams, joining the two layers together. The gusseted end is rectangular with four sides extending from the gusseted end.

"High density polyethylene (HDPE)" refers to a polyethylene having a density of about 0.95 g/cm$^3$ or greater.

"Layer" when used in the singular can have the dual meaning of a single element or a plurality of elements.

"Low density polyethylene (LDPE)" refers to a polyethylene having a density between about 0.91 and 0.925 g/cm$^3$.

"Medium density polyethylene (MDPE)" refers to a polyethylene having a density between about 0.926 and 0.949 g/cm$^3$.

"Polymers" include, but are not limited to, homopolymers, copolymers, such as for example, block, graft, random and alternating copolymers, terpolymers, etc. and blends and modifications thereof. Furthermore, unless otherwise specifically limited, the term "polymer" shall include all possible geometrical configurations of the material. These configurations include, but are not limited to isotactic, syndiotactic and atactic symmetries.

"Releasable" refers to the property of an element being capable of being removably bonded or removably secured to another element.

"Removably bonded," "removably secured" and variations thereof refer to two elements being connected or connectable such that the elements tend to remain connected absent a separation force applied to one or both of the elements, and the elements being capable of separation without substantial permanent deformation or rupture.

"Surface" includes any layer, film, woven, nonwoven, laminate, composite, or the like, whether pervious or impervious to air, gas, and/or liquids.

These terms may be defined with additional language in the remaining portions of the specification.

DETAILED DESCRIPTION OF THE PRESENTLY PREFERRED EMBODIMENTS

The present invention is directed to a bag in-pack enclosure combination. The bag contains and clearly displays an enclosure, such as a leaflet or coupon. The enclosure is immediately visible and available to a consumer upon opening the bag.

The principles of the present invention can be incorporated into any bag or similar type of packaging device. These bags are particularly suitable for packaging disposable absorbent articles. Examples of such suitable articles include diapers, training pants, feminine hygiene products, incontinence products, other personal care or health care garments, or the like.

Referring to FIG. 1, a bag 20, such as packaging for diapers, is illustrated in a filled position. An enclosure 22 is displayed on a first end 24 of the bag 20. The first end 24 of the bag 20 is located between a top layer 26 and a bottom layer 28 of the bag 20. Contents of the bag 20 are suitably put into the bag 20 via a second end 30 of the bag 20. The second end 30 is opposite the first end 24, and is formed between the top layer 26 and the bottom layer 28. The second end 30 can be sealed by a number of suitable methods, including adhesive bonding or heat bonding, after the contents have been placed in the bag 20.

The enclosure 22 can be a single, flat piece of material, such as a lone coupon, or can be a multi-folded material, such as a pamphlet or a combination of a pamphlet with a coupon included therein, for example. The enclosure 22 is located inside the bag 20 to prevent a person other than an end consumer from taking the enclosure 22 from the unopened bag 20.

Figure 2:
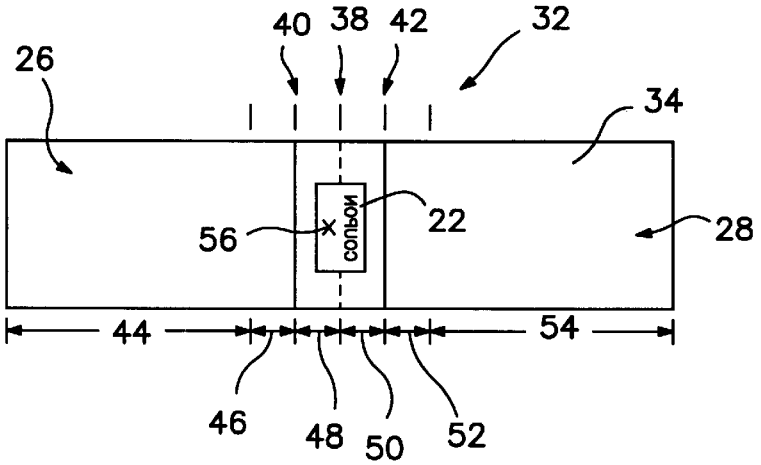
FIG. 2 is a plan view of a bag assembly in a stretched flat state and showing the surface that forms the interior of the bag.
Figure 3:
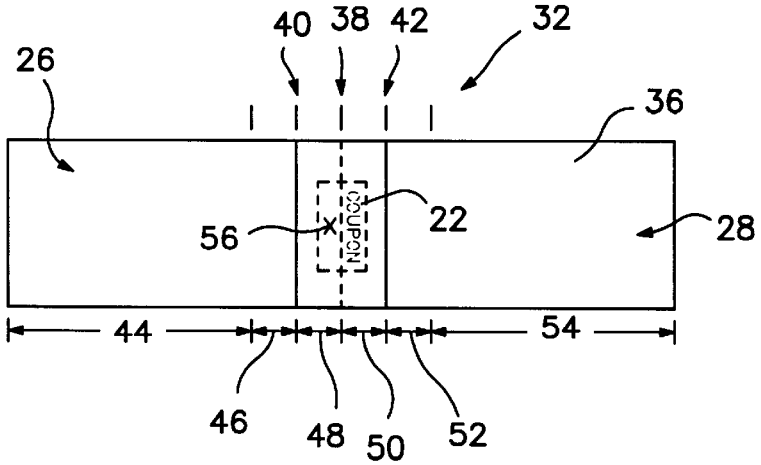
FIG. 3 is a plan view of a bag assembly in a stretched flat state and showing the surface that forms the exterior of the resulting bag.
Figure 4:
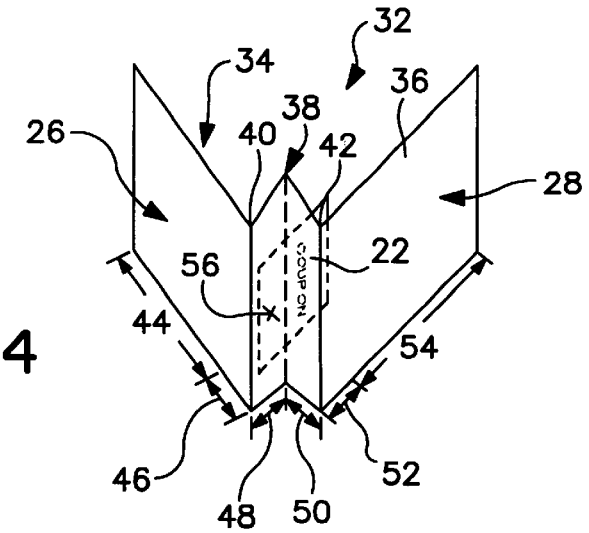
FIG. 4 is a plan view of a bag assembly being folded prior to bonding edges of the sides together.
Figure 6:
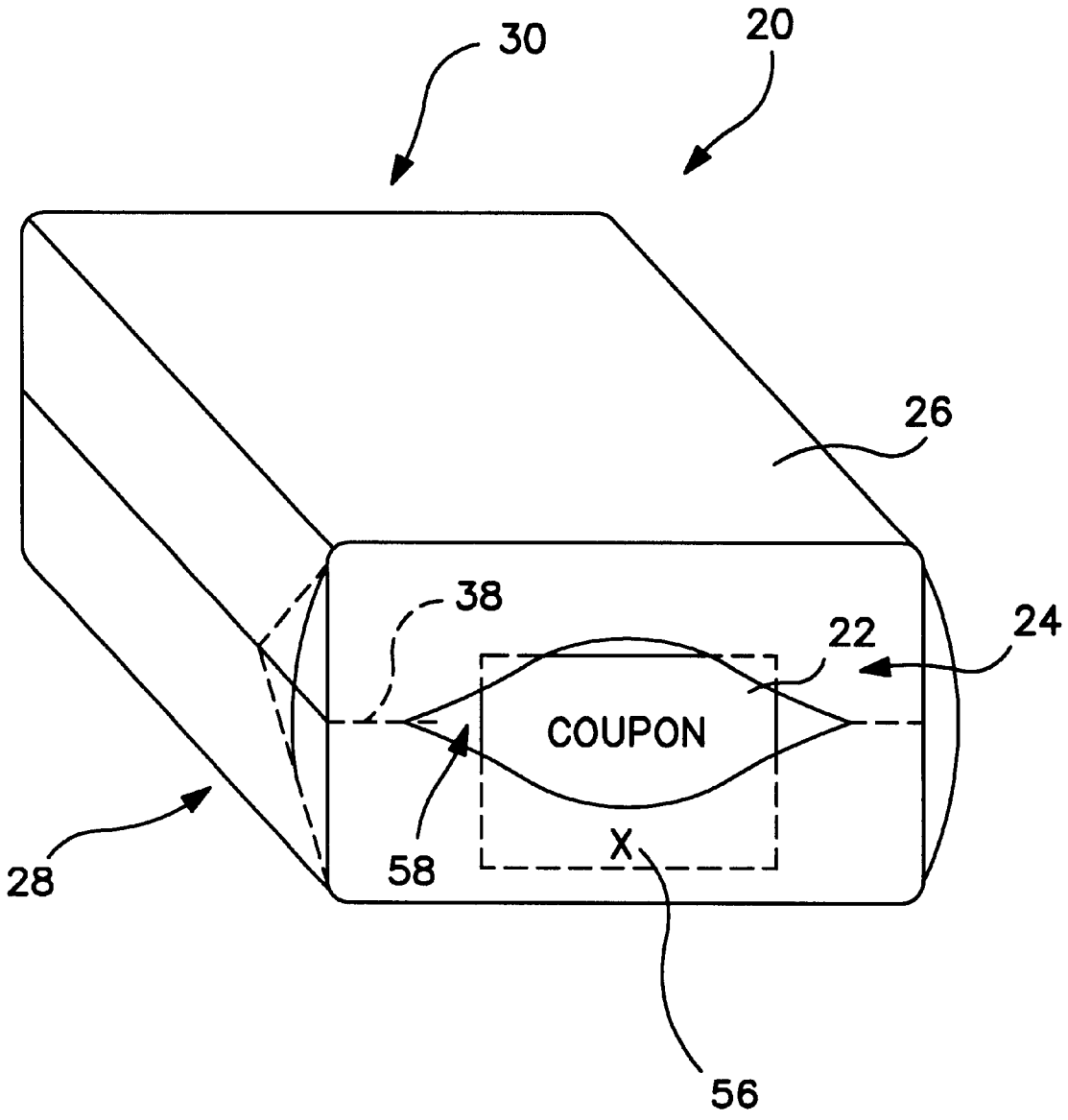
FIG. 6 is a perspective view of a bag in-pack enclosure wherein the bag is filled with contents and is open at one end.

The first end 24 of the bag 20 can be gusseted to form square corners and edges of the first end 24. The gusseted end 24 can be formed from a bag assembly 32 including a single piece of material, as shown in FIGS. 2 and 3. FIG. 2 shows an inner surface 34 of the bag assembly 32, while FIG. 3 shows an outer surface 36 of the bag assembly 32. The bag assembly 32 can be divided in half along line 38, thereby separating the bag assembly 32 into the top layer 26 and the bottom layer 28. Line 38 serves as a fold line to form a fold of the gusset on end 24. Line 38 can also be perforated to provide an opening 58 in the bag, as shown in FIG. 6. Alternatively, the perforation for the opening 58 can be separate from the fold line 38, for example, it can be positioned between line 40 and fold line 38, or between line 42 and fold line 38. The bag assembly 32 is folded in half along line 38, with the inner surface 34 of the top layer 26 facing the inner surface 34 of the bottom layer 28. The fold line 38 is tucked, or gusseted, to form lines 40 and 42 as fold lines that define a top edge and bottom edge of the first end 24, as shown in FIG. 4. Consequently, as shown in FIG. 4, the inner surface 34 of the top layer 26 along length 46 faces the inner surface 34 of the top layer 26 along length 48, the outer surface 36 of the top layer 26 along the length 48 faces the outer surface 36 of the bottom layer 28 along length 50, and the inner surface 34 of the bottom layer 28 along the length 50 faces the inner surface 34 of the bottom layer 28 along length 52. In this conformation, the four corresponding edges along lengths 46, 48, 50, and 52 and the corresponding bag edges along lengths 44 and 54 are simultaneously bonded together on opposite sides of the bag assembly 32. The bonding can be carried out in a number of different ways, including adhesive bonding, thermal bonding, ultrasonic bonding, and the like.

Either prior or subsequent to bonding the edges along lengths 44, 46, 48, 50, 52 and 54 together, the enclosure 22 is removably bonded at a point 56 to either the inner surface 34 of the top layer 26 within the length 48, or to the inner surface 34 of the bottom layer 28 within the length 50. When the enclosure 22 is removably secured to the inner surface 34 of the top layer 26 within the length 48, the enclosure 22 must not extend past line 40, in order for the enclosure 22 to lie flat when the bag 20 is in a flat, unfilled position. Likewise, when the enclosure 22 is removably secured to the inner surface 34 of the bottom layer 28 within the length 50, the enclosure 22 must not extend past line 42, in order for the enclosure 22 to lie flat when the bag 20 is in a flat, unfilled position. A releasable adhesive can be applied either directly to the inner surface 34 of the bag 20 or to the enclosure 22.

Figure 5:
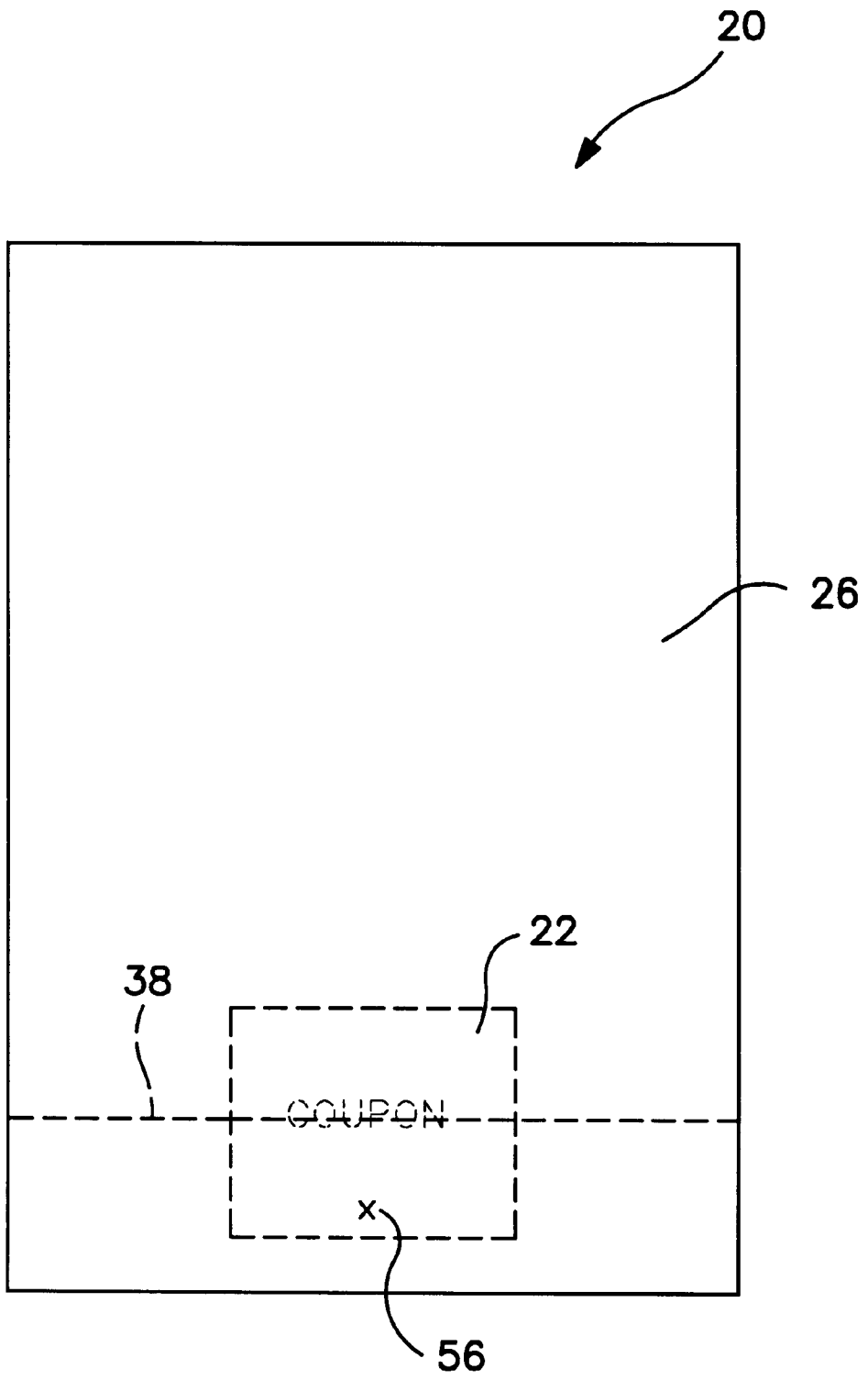
FIG. 5 is a plan view of a bag in-pack enclosure wherein the bag is in a flat, unfilled state.

When the edges of the bag assembly 32 along lengths 44/46, 48, 50, and 52/54 are bonded together, the enclosure 22 is removably secured to the inner surface 34 of the bag assembly 32, and the resulting bag 20 is in a flat, unfilled position, as shown in FIG. 5, the enclosure 22 lies flat within the bag 20. The flat conformation of the enclosure 22 within the bag 20 permits manageable stacking and storage of a plurality of the bags 20 on wickets, and also permits the processing of online formed bags.

When the bag 20 is filled, the gusseted end 24 unfolds and consequently realigns the enclosure 22 to a position roughly perpendicular to the top surface 26 and the bottom surface 28 of the bag 20, as shown in FIG. 1. Along with the enclosure 22, the portions of the top surface 26 and the bottom surface 28 along lengths 48 and 50 are also realigned to a position roughly perpendicular to the portions of the top surface 26 and the bottom surface 28. The perpendicular surface of the first end 24, including the portions along lengths 48 and 50, and the enclosure 22, creates a bag 20 that is easy to fill and easy to stack when filled, due to the resulting rectangular shape of the filled bag 20.

The opening 58 of the bag 20 on the first end 24 can be formed by the aforementioned perforated line corresponding to gusset fold line 38 or offset on either side of line 38, and can additionally include one or more perforated lines perpendicular to the perforated line 38 (not shown). When the perforated line 38 is torn open by the consumer, as shown in FIG. 6, the enclosure 22 is immediately within the consumer's view. The consumer can then simply remove the enclosure 22 and immediately access the information and/or other benefits provided by the enclosure 22.

The bag 20 can be constructed of paper or a polymer or any other suitable materials. Suitably, the bag 20 is constructed of a flexible polymer film having sufficient strength to hold and contain the contents of the bag 20 without breaking and without excessive bulging or stretching of the film material. For example, the film material may be composed of a polyethylene film or film laminate having a thickness of about 2.0 mils (about 0.0508 millimeters). Furthermore, the film may include a LDPE (low density polyethylene) film, a LDPE/LLDPE (linear low density polyethylene) film laminate, a LDPE/MDPE (medium density polyethylene) film laminate, a LDPE/HDPE (high density polyethylene) film laminate or the like.

The bag 20, or at least portions thereof, can be transparent to enable the consumer to view the contents of the bag 20 and/or the enclosure 22 within the bag 20 prior to purchasing the product within the bag 20. Alternatively, the bag 20, or at least portions thereof, can be opaque, thus possibly surprising the consumer with the enclosure 22 that is immediately visible once the bag 20 is opened.

The bag 20 can be made in a wide range of sizes. For example, a suitable size for packaging diapers includes the top layer 26 and the bottom layer 28 each having a total length of about 40 centimeters and a width of about 26 centimeters, with each of the folded lengths 48 and 50 being roughly 5.5 centimeters.

As described herein, the bag 20 can be manufactured simply with minimal additional material and manufacturing costs attributable to the insertion and securing of the enclosure 22 within the bag 20.

It will be appreciated that details of the foregoing embodiments, given for purposes of illustration, are not to be construed as limiting the scope of this invention. Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention, which is defined in the following claims and all equivalents thereto. Further, it is recognized that many embodiments may be conceived that do not achieve all of the advantages of some embodiments, particularly of the preferred embodiments, yet the absence of a particular advantage shall not be construed to necessarily mean that such an embodiment is outside the scope of the present invention.

I claim:

1. A bag, comprising:

a top layer;

a bottom layer;

a gusseted end formed between the top layer and the bottom layer; and an enclosure removably secured to an inner surface of the gusseted end with a releasable adhesive within the bag, wherein the gusseted end, when folded, maintains the enclosure in a plane substantially parallel to the top layer and to the bottom layer; and the gusseted end, when unfolded, aligns the enclosure in a position substantially perpendicular to the top layer and to the bottom layer.

2. The bag of claim 1, further comprising a bag opening within the gusseted end.

3. The bag of claim 2, wherein the enclosure is removably secured to the gusseted end adjacent the bag opening.

4. The bag of claim 1, wherein the bag comprises a polymer.

5. The bag of claim 1, wherein the bag comprises paper.

6. The bag of claim 1, wherein the bag comprises a transparent material.

7. The bag of claim 1, comprising a package used for packing disposable absorbent articles.

8. The bag of claim 1, wherein the enclosure comprises a leaflet.

9. The bag of claim 1, wherein the enclosure comprises a coupon.

10. The bag of claim 1, wherein the enclosure is a single, flat piece of material.

11. The bag of claim 1, wherein the enclosure is multi-folded.

12. A bag, comprising:

a top layer;

a bottom layer;

a bag opening formed between the top layer and the bottom layer; and an enclosure removably secured to an inner surface of the bag adjacent the bag opening, wherein the bag, when empty, maintains the enclosure in a plane substantially parallel to the top layer and to the bottom layer; and the bag, when filled, aligns the enclosure in a position substantially perpendicular to the top layer and to the bottom layer.

13. The bag of claim 12, further comprising a gusseted end formed between the top layer and the bottom layer.

14. The bag of claim 13, wherein the bag opening is formed within the gusseted end.

15. The bag of claim 12, wherein the enclosure is removably secured to an inner surface of the top layer adjacent the bag opening.

16. The bag of claim 12, wherein the enclosure is removably secured to an inner surface of the bottom layer adjacent the bag opening.

17. The bag of claim 12, wherein the bag opening is defined by at least one tear line.

18. A method of making a bag in combination with an enclosure, comprising the steps of:

aligning a top layer with a bottom layer;

bonding at least two edges of the top layer to at least two edges of the bottom layer;

forming an opening between the top layer and the bottom layer; and removably securing an enclosure to an inner surface of the bag adjacent the bag opening, such that when the bag is empty the enclosure is maintained in a plane substantially parallel to the top layer and to the bottom layer, and when the bag is filled the enclosure is aligned in a position substantially perpendicular to the top layer and to the bottom layer.

19. The method of claim 18, further comprising the step of forming a gusseted end between the top layer and the bottom layer.

20. The method of claim 19, wherein the opening is located on the gusseted end.

21. The method of claim 18, further comprising the step of removably securing the enclosure to the inner surface of the bag with a releasable adhesive.

22. The method of claim 18, further comprising the step of removably securing the enclosure to an inner surface of the top layer adjacent the bag opening.

23. The method of claim 18, further comprising the step of removably securing the enclosure to an inner surface of the bottom layer adjacent the bag opening.

* * * * *